United States Patent [19]

Nimura et al.

[11] Patent Number: 5,034,773

[45] Date of Patent: Jul. 23, 1991

[54] DEVELOPING UNIT WITH A MEMBER FOR AGITATING THE TONERS IN A DEVELOPER

[75] Inventors: Eiji Nimura, Tondabayashi; Wataru Yoshida, Hirakata, both of Japan

[73] Assignee: Mita Industrial Co., Ltd., Osaka, Japan

[21] Appl. No.: 528,643

[22] Filed: May 27, 1990

[30] Foreign Application Priority Data

May 30, 1989 [JP] Japan ..... 1-63525

[51] Int. Cl.[5] ..... G03G 21/00

[52] U.S. Cl. ..... 355/246; 118/653; 118/657; 355/245; 355/251; 355/253; 355/259; 355/260

[58] Field of Search ..... 355/245, 246, 250, 251, 355/253, 255, 259, 260; 118/653, 656, 657, 658

[56] References Cited

U.S. PATENT DOCUMENTS 4,855,783 8/1989 Takashima et al. ..... 355/245 X
4,862,213 8/1988 Ichihara et al. ..... 355/245
4,867,100 9/1989 Yamazaki et al. ..... 355/253 X

*Primary Examiner*—Arthur T. Grimley
*Assistant Examiner*—Shuk Y. Lee
*Attorney, Agent, or Firm*—Armstrong, Nikaido, Marmelstein, Kubovcik, & Murray

[57] ABSTRACT

A developing unit in which an electrostatic latent image is formed on a photoconductor with toners transported with carriers in a developer. The toners are supplied as needed from a toner hopper. The developing unit includes an agitation roller for agitating the toners supplied from the toner hopper with the developer, and a developer regulating member for regulating the amount of the developer transported along the circumferential surface of the agitation roller toward the area where the developer is agitated and mixed with the toners supplied from the toner hopper.

6 Claims, 3 Drawing Sheets

DEVELOPING UNIT WITH A MEMBER FOR AGITATING THE TONERS IN A DEVELOPER

BACKGROUND OF THE INVENTION

1. Field of the invention:

The present invention relates to a developing unit used in an image forming apparatus such as an electrophotographic copying machine or the like, and more particularly, to a developing unit which utilizes a two-component developer consisting of toners and carriers.

2. Description of the prior art:

In an electrophotographic copying machine, an electrostatic latent image formed on a photoconductor is developed with toners into a toner image by means of a developing unit. FIG. 3 shows one example of a developing unit which utilizes a two-component developer consisting of toners and carriers. Usually, in such a developing unit, the developer is carried on the outer circumferential surface of a developing sleeve 52 disposed facing a photoconductor drum 10, and the toners contained in the developer being carried are made to adhere to an electrostatic latent image on the photoconductor drum 10 as the developing sleeve 52 revolves, thus developing the latent image into a toner image. Since the toners in the developer in the developing unit are gradually consumed as they are used for developing electrostatic latent images, new toners are supplied as needed to the developing unit from a toner hopper 30.

In the developing unit, an agitation roller 54 is disposed beneath the toner hopper 30 in order to adequately agitate and mix the supplied toners into the developer accommodated in the developing unit. Disposed between the agitation roller 54 and the developing sleeve 52 is a mixing roller 56, above which a partition plate 57 is disposed. There is also disposed, above the developing sleeve 52, a doctor blade 58 which is used to regulate the amount of developer carried on the rotating surface of the developing sleeve 52. The developer stopped by the doctor blade 58 is transported along the upper surface of the partition plate 57 toward the upper portion of the agitation roller 54. The toners supplied from the toner hopper 30 are agitated and mixed with the developer by means of the agitation roller 54 and the mixing roller 56. The rotating direction of the agitation roller 54 disposed beneath the toner hopper 30 is usually set in such a way that the developer flowing down along the upper surface of the partition plate 57 runs counter to the flow of the developer being carried on the rotating surface of the agitation roller 54. The rotating direction of the agitation roller 54 is also set in the same manner mentioned above, even if the mixing roller 56 is not provided in the developing unit and only the agitation roller 54 is disposed beneath the toner hopper 30.

In the developing unit having the above-mentioned construction, since the developer consisting of toners and carriers accommodated in the developing unit has a greater specific gravity than the toners supplied to the developing unit, the supplied toners cannot be easily mixed into the developer being carried on the rotating surface of the agitation roller 54, and may therefore remain afloat over the developer existing in the upper portion of the agitation roller 54, especially when the flowing speed of the developer on the rotating surface of the agitation roller 54 is not fast enough, or the developer taken up by the agitation roller 54 exhibits a flowing movement such as shown by an arrow F, or when the developer above the rotating surface of the agitation roller 54 is pushed by the developer flowing down from the partition plate 57 and forced in the opposite direction to that of the rotation of the agitation roller 54. Thus, when the toners keep afloat over the developer, the toner density with respect to the developer in the developing unit may not increase substantially, but the final image density may decrease. Also, since the toners are supplied by rotating a toner supply roller 31 disposed in the toner hopper 30 when the toner density in the developing unit decreases, if the supplied toners remain afloat over the developer being carried on the agitation roller 54, it is possible that the toner density may abruptly increase after the completion of the toner supply, thus resulting in the final image being fogged. Furthermore, if the developing unit is operated after it is once stopped with the supplied toners remaining afloat over the developer on the surface of the agitation roller 54, the operation of the developing unit will cause the toners floating over the developer on the surface of the agitation roller 54 to be mixed into the developer, resulting in a sudden increase in the toner density. This causes such problems as splashing of toners around the developing unit and changes in the final image density during a continuous copy operation.

If the agitation roller 54 is made to rotate in the opposite direction, the supplied toners can be prevented from remaining afloat over the developer carried on the rotating surface of the agitation roller 54, making it easier for the toners to be agitated and mixed into the developer, but this in turn causes another problem in the reduction in agitation efficiency because the developer flowing down along the upper surface of the partition plate 57 does not run counter to the flow of the developer being carried on the rotating surface of the agitation roller 54.

SUMMARY OF THE INVENTION

The developing unit of the present invention, which overcomes the above-discussed and numerous other disadvantages and deficiencies of the prior art, wherein an electrostatic latent image, formed on a photoconductor, is developed with toners transported with carriers in the developer and the toners are supplied as needed from a toner hopper. The developing unit includes an agitation roller for agitating the toners supplied from the toner hopper into the developer (accommodated in the developing unit), and a developer regulating member for regulating the amount of the developer transported along the circumferential surface of the agitation roller toward the area where the developer is agitated and mixed with the toners supplied from the toner hopper.

In a preferred embodiment, the developer regulating member comprises a guide surface for guiding the toners supplied from the toner hopper to the area where the toners are agitated and mixed into the developer being carried on the agitation roller.

In a preferred embodiment, the developing unit of the present invention comprises a preliminary agitation chamber for preliminarily agitating the toners supplied from the toner hopper.

In a preferred embodiment, the agitation roller is disposed in the preliminary agitation chamber.

Thus, the invention described herein makes possible the objective of providing a developing unit in which the supplied toners can be thoroughly mixed into the developer without reducing the agitation efficiency of the toners and the developer, quickly stabilizing the toner density of the developer.

Also, since the developing unit of the present invention is so constructed that the developer is agitated with the toners supplied from the toner hopper after regulating the amount of the developer carried on the agitation roller by the developer regulating member, the supplied toners are thoroughly agitated and mixed into the developer without remaining afloat over the developer. Therefore, another objective of the present invention is to provide a developing unit in which the toner density in the developer increases without delay after supply of the toners and there is no possibility of deterioration in the image quality of the copy image developed with toners.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
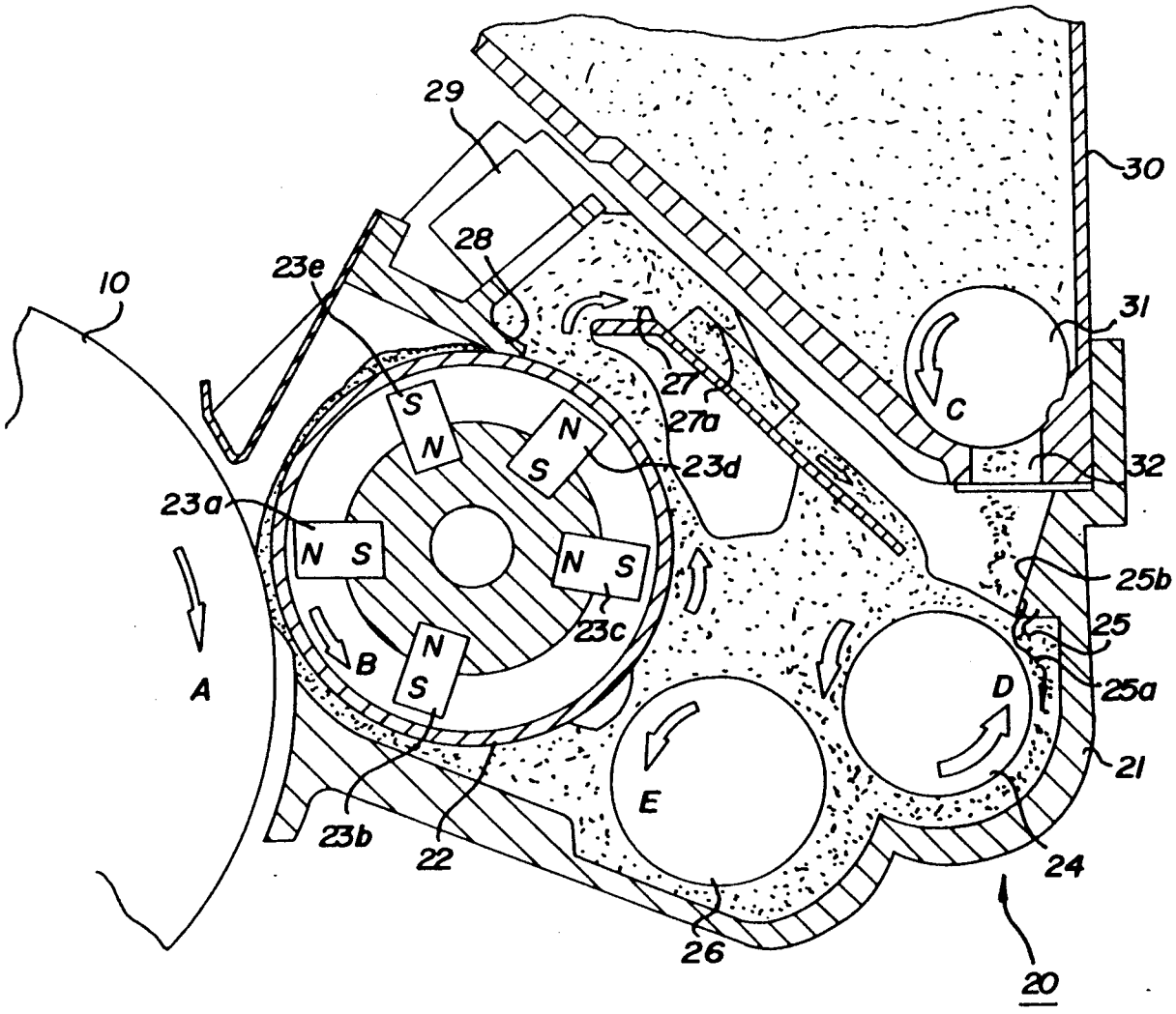
FIG. 1 is a cross sectional view showing a developing unit of the present invention.

Referring to the drawings, preferred embodiments of the present invention are now described below.

FIG. 1 shows one embodiment of the present invention. A developing unit 20 is installed adjacent to a photoconductor drum 10 in an image forming apparatus such as an electrophotographic copying machine or the like. The photoconductor drum 10 rotates, for example, in the direction shown by the arrow A in FIG. 1. As the photoconductor drum 10 revolves, an electrostatic latent image is formed on the circumferential surface thereof.

The developing unit 20 of the present invention is provided with a housing 21 which accommodates a two-component developer consisting of toners and carriers. A cylindrical developing sleeve 22 is disposed inside the housing 21 and facing the photoconductor drum 10. The developing sleeve 22 rotates in the direction shown by an arrow B so that the portion thereof facing the photoconductor drum 10 moves in the forward direction (same direction) with respect to the rotating direction of the photoconductor drum 10.

A plurality of magnets (in this example, five magnets) **23*a*, 23*b*, 23*c*, 23*d*, and 23*e* are fixed in the developing sleeve 22. One magnet 23*a* is disposed in the position facing the photoconductor drum 10 with the wall of the developing sleeve 22 between them, and downstream of the magnet 23*a* in the rotating direction of the developing sleeve 22, the magnets 23*b*, 23*c*, 23*d*, and 23*e* are disposed in this order with an appropriate spacing provided between each other. Each of the magnets 23*a* to 23*e* is elongated in the radial direction of the developing sleeve 22, and has magnetic poles of the opposite type at each end, respectively. For example, the magnet 23*a* facing the photoconductor drum 10 has its N pole at its outer end which is close to the photoconductor drum 10. In the clockwise direction from the magnet 23*a*, the magnets 23*e*, 23*d*, and 23*c* have S, N, and S poles formed at their respective outer ends. This means that the outer magnetic poles of the magnets 23*a*, 23*e*, 23*d*, and 23*c* are of opposite types between the adjacent ones. On the other hand, the outer end of the magnet 23*b*, which is disposed adjacent to the magnet 23*a* facing the photoconductor drum 10 in the rotating direction of the developing sleeve 22, is provided with a magnetic pole of S type. Therefore, the outer magnetic pole (S) of the magnet 23*b* is of opposite type from the outer magnetic pole (N) of the magnet 23*a* facing the photoconductor drum 10, and of the same type as the outer magnetic pole (S) of the magnet 23*c* disposed adjacent to the magnet 23*b* in the rotating direction of the developing sleeve 22**.

A toner hopper 30 is disposed in the upper portion in the housing 21 and in the opposite side from the side where the developing sleeve 22 is disposed. Disposed in the lower part of the toner hopper 30 is a toner supply roller 31. Below the toner supply roller 31 is disposed a toner supply port 32 which communicates with the inside of the housing 21 of the developing unit 20. The toner supply roller 31 rotates in the direction shown by arrow C in FIG. 1, by this rotation the toners in the toner hopper 30 are supplied through the toner supply port 32 into the housing 21 of the developing unit 20.

In the housing 21 of the developing unit 20 and beneath the toner supply port 32, there is disposed an agitation roller 24. The agitation roller 24 rotates in the direction shown by arrow D. Therefore, the developer in the housing 21 is transported upwardly from under the agitation roller 24 by the rotation thereof along the opposite side of the housing 21 from the side where the photoconductor drum 10 is disposed. In an area where the developer is carried (hereinafter the area is referred to as the developer carrying area) along the circumferential surface of the agitation roller 24 toward an area where the developer is agitated for mixture with the toners supplied from the toner hopper 30 (hereinafter the area is referred to as the agitation area), an edge portion of a developer regulating member 25 projects inwardly from a side wall of the housing 21. The developer regulating member 25 covers almost the entire width of the agitation roller 24 in the axial direction thereof, and, in this embodiment, is formed integrally with the side wall of the housing 21. The developer regulating member 25 includes a regulating surface **25*a* formed in a substantially horizontal position and a guide surface 25*b* extending upwardly from the edge of the regulating surface 25*a* in a sloping fashion toward the side of the housing 21. The regulating surface 25*a* serves to regulate the amount of developer carried by the agitation roller 24 toward the agitation area, while the guide surface 25*b* serves to guide the toners falling through the toner supply port 32 toward the upper portion of the agitation roller 24**.

Disposed between the agitation roller 24 and the developing sleeve 22 is a mixing roller 26. The mixing roller 26 rotates in the direction shown by arrow E, the same direction as the rotation of the agitation roller 24 and the developing sleeve 22.

Disposed above the mixing roller 26 is a partition plate 27 extending from the upper portion of the developing sleeve 22 and sloping down toward the upper portion of the agitation roller 24. Above the developing sleeve 22, there is disposed a doctor blade 28. The doctor blade 28 projects from the housing 21 in the direction opposite to the rotating direction of the developing sleeve 22. A prescribed gap is provided between the edge of the doctor blade 28 and the rotating surface of the developing sleeve 22 so that the edge of the doctor blade 28 regulates the amount of developer carried on the rotating surface of the developing sleeve 22. The developer prevented by the doctor blade 28 from being carried on the rotating surface of the developing sleeve 22 is guided along the upper surface of the partition plate 27 to flow toward the upper portion of the agitation roller 24. On the upper surface of the partition plate 27, there are disposed a plurality of straightening plates 27*a* appropriately spaced apart in the axial direction of the developing sleeve 22. The straightening plates 27*a* serve to straighten the flow of developer flowing down from the upper surface of the partition plate 27.

Also disposed in the housing 21 is a toner density sensor 29 for sensing the toner density of the developer being regulated by the doctor blade 28 and carried toward the partition plate 27. When the toner density sensor 29 senses that the toner density in the housing 21 is reduced below a prescribed level, the toner supply roller 31 in the toner hopper 30 is driven for rotation to supply toners from the toner hopper 30 to the housing 21 of the developing unit 20.

The developing unit 20 of the present invention having the above construction operates in the following manner. When the photoconductor drum 10 rotates, the developing sleeve 22, the agitation roller 24, and the mixing roller 26 in the developing unit 20 are made to rotate. This causes the developer in the housing 21 to be agitated and mixed by the agitation roller 24 and the mixing roller 26, the agitated and mixed developer being attracted to the magnet 23*c* in the developing sleeve 22. Thus, the developer is carried on the rotating surface of the developing sleeve 22, forming a magnetic brush thereon by means of the rotation of the developing sleeve 22 and the magnetic force of each magnet in the developing sleeve 22. The amount of the developer being carried on the developing sleeve 22 is regulated by the doctor blade 28, and the developer which is not stopped by the doctor blade 28 is brought to the position facing the photoconductor drum 10.

In the meantime, an electrostatic latent image is formed on the circumferential surface of the photoconductor drum 10 which rotates so that the area where the latent image is formed is brought to the position facing the developing sleeve 22. In this situation, the developer carried on the rotating surface of the developing sleeve 22 comes into contact with the surface of the photoconductor drum 10 at the developing position where the developer comes closest to the photoconductor drum 10, thus accomplishing toner development of the electrostatic latent image on the photoconductor drum 10.

The developer prevented by the doctor blade 28 from being carried on to the rotating surface of the developing sleeve 22 is directed toward the partition plate 27 and flows down the upper surface thereof. Being guided along the partition plate 27, the developer is transported to the developer carrying area on the agitation roller 24. With the flow of the developer straightened by the straightening plates 27*a* on the partition plate 27, the developer runs counter to the flow in the developer carrying area on the agitation roller 24.

The developer that runs counter to the developer in the developer carrying area on the agitation roller 24 is agitated by the agitation roller 24, and then is transported to the developer carrying area on the mixing roller 26, in which the developer is transported back to the developer carrying area on the developing sleeve 22.

As the developer is thus circulated in the developing unit 20, the toners in the developer are consumed. When the toners are consumed and the toner density sensor 29 senses the reduction in the toner density of the developer in the developing unit 20, the toner supply roller 31 in the toner hopper 30 is driven to rotation. Due to the rotation of the toner supply roller 31, the toners in the toner hopper 30 are supplied through the toner supply port 32 into the housing 21 of the developing unit 20 and flow into the developer carrying area on the agitation roller 24. At this time, the developer carried along the rotating surface of the agitation roller 24 by the rotation of the agitation roller 24 is moved upward from under the agitation roller 24 with its amount regulated by the developer regulating member 25. Therefore, the developer carried along the surface in the upper part of the agitation roller 24 without being regulated by the developer regulating member 25 moves at a faster speed than when the carrying amount of the developer is not regulated. This helps the toners supplied from the toner hopper 30 to be efficiently transported to the area where the developer is flowing in a belt-like manner from the partition plate 27. As a result, the toners supplied from the toner hopper 30 is thoroughly agitated with the developer being carried along the surface of the upper part of the agitation roller 24 without staying afloat thereon. As previously described, the thus agitated developer is transported by the mixing roller 26 to the developer carrying area on the developing sleeve 22, and is carried by the rotation of the developing sleeve 22, forming a magnetic brush on the rotating surface thereof.

Since the toners supplied to the housing 21 of the developing unit 20 is quickly mixed into the developer in the housing 21, the toner density of the developer increases in a short time.

It is preferable to provide a gap within the range of 1 to 5 mm between the developer regulating member 25 which regulates the amount of developer to be carried on the rotating surface of the agitation roller 24 and the rotating surface of the agitation roller 24. A gap smaller than 1 mm would cause abrasion of developer passing therethrough, thus accelerating deterioration of the developer. This could result in degradation in the final copy image or an increase in the toner density of the developer. On the other hand, a gap greater than 5 mm could cause the supplied toners to remain afloat over the developer. When the size of a carrier particle in the developer is about 100 μm, the gap of about 3 mm will be most suitable.

The above-discussed embodiment has been described dealing with the developing unit 20 having both the agitation roller 24 and the mixing roller 26, but it must be appreciated that the present invention is also applicable to a developing unit in which the mixing roller 26 is not provided.

Also, the present invention is not limited to the construction in which the toner supply port 32 is positioned above the agitation roller 24, but the invention is also applicable, for example, to the construction in which the toner supply port 32 is disposed above the partition plate 27.

Figure 2:
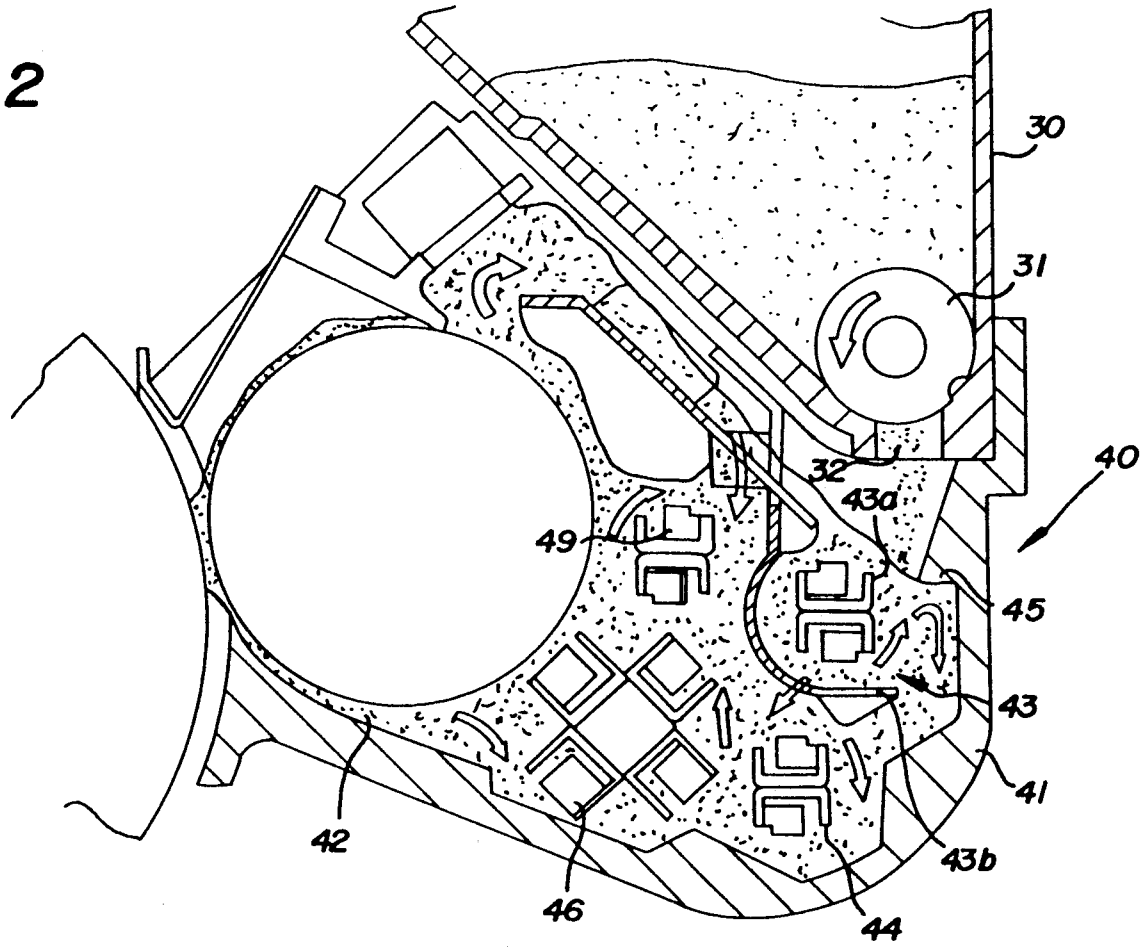
FIG. 2 is a cross sectional view showing another developing unit of the present invention.
Figure 3:
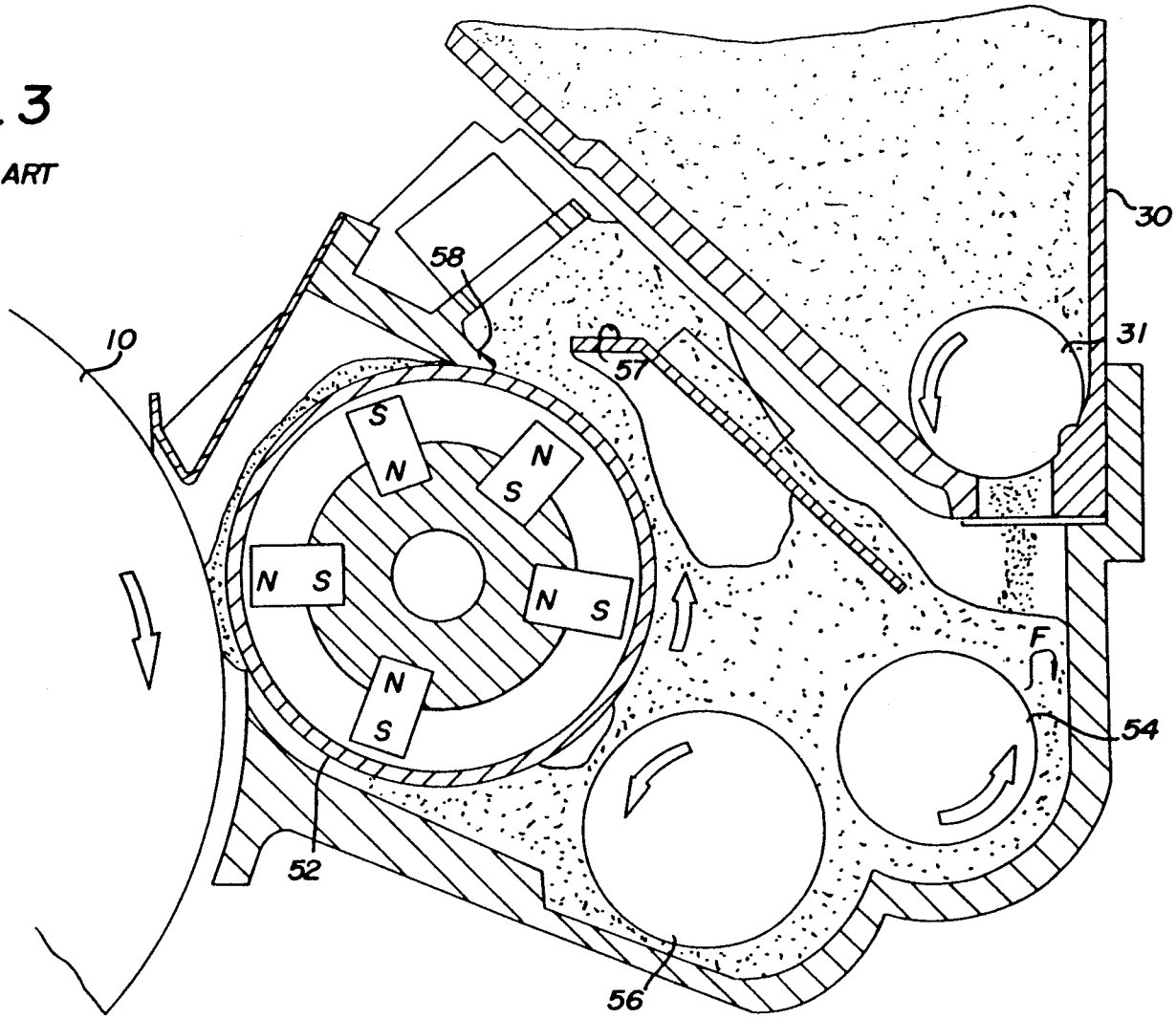
Fig. 3 PRIOR ART
FIG. 3 is a cross sectional view showing a conventional developing unit.

Furthermore, the present invention can be applied to a developing unit 40 shown in FIG. 2. In the developing unit 40, a preliminary agitation chamber 43 is provided within a housing 41 to provide a longer agitation time for the supplied toners to be mixed thoroughly into the developer, the preliminary agitation chamber 43 having an agitation roller 43*a* disposed therein. The preliminary agitation chamber 43 of the developing unit 40 is formed by partitioning off the portion of the housing 41 facing a toner supply port 32 of a toner hopper 30 using a partition wall 43*b*. The agitation roller 43*a* disposed inside the preliminary agitation chamber 43 revolves to carry the developer upward along a side wall of the housing 41 while the toners are supplied from the toner hopper 30 over the developer being carried by the agitation roller 43*a*. Also disposed inside the preliminary agitation chamber 43 is a developer regulating member 45 which regulates the amount of developer carried toward the area where the toners are agitated by the agitation roller 43*a*.

Beneath the preliminary agitation chamber 43, there is disposed a second agitation roller 44 which is rotatable in the opposite direction to that of the rotation of the agitation roller 43*a* disposed inside the preliminary agitation chamber 43. The developer in the preliminary agitation chamber 43 flows downward through the gap between the housing 41 and the partition wall 43*b*, and also through an opening formed in the partition wall 43*b*, and is agitated by the second agitation roller 44. A mixing roller 46 is disposed adjacent to the side of the second agitation roller 44 nearer to a developing sleeve 42. Above the mixing roller 46, an auxiliary agitation roller 49 is disposed. Other construction is substantially the same as that of the foregoing embodiment, therefore, further description is omitted herein.

In this embodiment also, the developer regulating member 45 disposed inside the preliminary agitation chamber 43 serves to regulate the amount of developer carried by the agitation roller 43*a* in the preliminary agitation chamber 43 toward the agitation area where the supplied toners are agitated. As a result, the developer carried on the rotating surface of the agitation roller 43*a* is transported at a faster speed at the agitation area of the supplied toners, thus allowing the supplied toners to be thoroughly agitated and mixed into the developer.

It is understood that various other modifications will be apparent to and can be readily made by those skilled in the art without departing from the scope and spirit of this invention. Accordingly, it is not intended that the scope of the claims appended hereto be regulated to the description as set forth herein, but rather that the claims be construed as encompassing all the features of patentable novelty that reside in the present invention, including all features that would be treated as equivalents thereof by those skilled in the art to which this invention pertains.

What is claimed is:

1. A developing unit in which a developer mixed with toners, which are supplied as needed from a toner hopper, are regulated by a doctor blade into a predetermined amount and transported on a developing sleeve, said developing sleeve developing an electrostatic latent image formed on a photoconductor during transportation, developer, which is prevented by said doctor blade from being transported on said developing sleeve, flows back to a position where said toners are supplied as needed from said toner hopper, said developing unit comprising:

an agitation roller for agitating said developer which flows back and said toners from said toner hopper with developer which is located in said developing unit; and a developer regulating member, projecting from a side wall of said developing unit, regulating an amount of said developer transported along a circumferential surface of said agitation roller toward an area where said developer is agitated and mixed with said toners from said toner hopper by said agitation roller.

2. A developing unit according to claim 1, wherein said developer regulating member comprises a guide surface for guiding the toners supplied from said toner hopper to the area where the toners are agitated and mixed with the developer being carried on said agitation roller.

3. A developing unit according to claim 1, comprising a preliminary agitation chamber for preliminarily agitating the toners supplied from said toner hopper.

4. A developing unit according to claim 3, wherein said agitation roller is disposed in said preliminary agitation chamber.

5. A developing unit comprising:

a toner hopper supplying, as needed, toners to be mixed with a developer;

a developing sleeve developing an electrostatic latent image formed on a photoconductor during transportation;

a doctor blade for regulating the amount of mixed developer and toners transported on said developing sleeve, developer which is prevented by said doctor blade from being transported on said developing sleeved flowing back to a position where said toners are supplied from said toner hopper;

a partition plate for guiding said developer flowing back from said doctor blade to said position where toners are supplied from said toner hopper;

an agitation roller for agitating said developers which flow back and said toners from said toner hopper with developer which is located in said developing unit; and a developer regulating member, projecting from a side wall of said developing unit, regulating an amount of said developer transported along said circumferential surface of said agitating roller toward an area where said developer is agitated and mixed with said toners from said toner hopper by said agitation roller.

6. A developing unit comprising:

a toner hopper supplying, as needed, toners to be mixed with a developer;

a developing sleeve developing an electrostatic latent image formed on a photoconductor during transportation;

a doctor blade for regulating the amount of mixed developer and toners transported on said developing sleeve, developer which is prevented by said doctor blade from being transported on said developing sleeved flowing back to a position where said toners are supplied from said toner hopper;

an agitation roller for agitating said developers which flow back and said toners from said toner hopper with developer which is located in said developing unit; and a developer regulating member, projecting from a side wall of said developing unit, regulating an amount of said developer transported along said circumferential surface of said agitating roller toward an area where said developer is agitated and mixed with said toners from said toner hopper by said agitation roller.

* * * * *